US005481888A

United States Patent [19]

Perry

[11] Patent Number: 5,481,888

[45] Date of Patent: Jan. 9, 1996

[54] TERMINATION DEVICE FOR FLEXIBLE CABLE

[76] Inventor: Robert C. Perry, 5755 SW. Willow La., Lake Oswego, Oreg. 97035-5340

[21] Appl. No.: 293,145

[22] Filed: Aug. 19, 1994

[51] Int. Cl.[6] ..... E05B 73/00

[52] U.S. Cl. ..... 70/18; 70/57; 403/312

[58] Field of Search ..... 70/14, 18, 57, 70/58, 63; 403/309, 310, 312, 315, 316, 391, 396; 24/115 K; 439/501

[56] References Cited

U.S. PATENT DOCUMENTS

| | | | |
|---|---|---|---|
| 516,602 | 3/1894 | Kershaw | 403/312 X |
| 1,665,531 | 4/1928 | Cole | 403/315 X |
| 2,271,270 | 1/1942 | McLearn | 403/391 |
| 2,440,012 | 5/1944 | Haver . | |
| 3,044,807 | 7/1962 | Brisse | 403/396 |
| 3,797,947 | 3/1974 | Foote | 403/315 X |
| 3,817,064 | 6/1974 | Sallee . | |
| 3,987,653 | 10/1976 | Lyon et al. . | |
| 4,057,982 | 11/1977 | Drayton | 70/18 X |
| 4,146,242 | 3/1979 | Böse . | |
| 4,157,602 | 6/1979 | Pennell | 70/18 X |
| 4,662,035 | 5/1987 | Hatfield | 403/391 X |
| 4,817,402 | 4/1989 | Leiding . | |
| 4,974,549 | 12/1990 | Gordon | 24/115 K X |
| 5,070,712 | 12/1991 | Fox . | |
| 5,181,402 | 1/1993 | Faessler et al. . | |
| 5,219,384 | 6/1993 | Elsfelder et al. | 70/18 |

*Primary Examiner*—Peter M. Cuomo
*Assistant Examiner*—Monica E. Millner
*Attorney, Agent, or Firm*—Smith-Hill and Bedell

[57] ABSTRACT

A device for attachment to a cable comprises two jaws each having a clamping face in which it is formed with two recesses. When the jaws are placed with their clamping faces in confronting relationship, the recesses form two cavities for receiving two lengths of cable separated by a bight. A pair of screws and nuts clamp the jaws together and releasably retain the lengths of cable in the respective cavities.

22 Claims, 2 Drawing Sheets

TERMINATION DEVICE FOR FLEXIBLE CABLE

BACKGROUND OF THE INVENTION

This relations relates to a termination device for a flexible cable.

It is known to secure portable equipment against theft by use of a security anchor comprising a cable having a loop formed at one end by crimping a metal ferrule about the cable. This type of loop is subject to disadvantage, in that it is permanently formed and cannot be selectively opened and closed. Further, special equipment is required in order to crimp the metal ferrule, and this renders it difficult for the normal user of such a security anchor to form a loop, and the user therefore has to obtain a cable with a preformed loop from an outside source. This necessitates that the user decide in advance the length of cable that is required, and if the user decides to use the cable in a different application, the cable might not be of the proper length, so that the user must then obtain a further cable with a loop.

SUMMARY OF THE INVENTION

In accordance with a first aspect of the present invention there is provided a device for attachment to a length of rod-like material, comprising first and second jaw members each having a clamping face in which it is formed with at least one recess, whereby when the jaw members are placed with their clamping faces in confronting relationship, the recesses form a cavity for receiving the length of rod-like material, and at least one removable clamping element for clamping the jaw members together and thereby releasably retaining the length of rod-like material in the cavity.

In accordance with a second aspect of the present invention there is provided a device for securing two lengths of rod-like material together, comprising first and second jaw members each having a clamping face in which it is formed with two recesses, whereby when the jaw members are placed with their clamping faces in confronting relationship, the recesses form two cavities for receiving the two lengths of rod-like material respectively, and at least one removable clamping element for clamping the jaw members together and thereby releasably retaining the two lengths of rod-like material in the cavities respectively.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION

Figure 2:
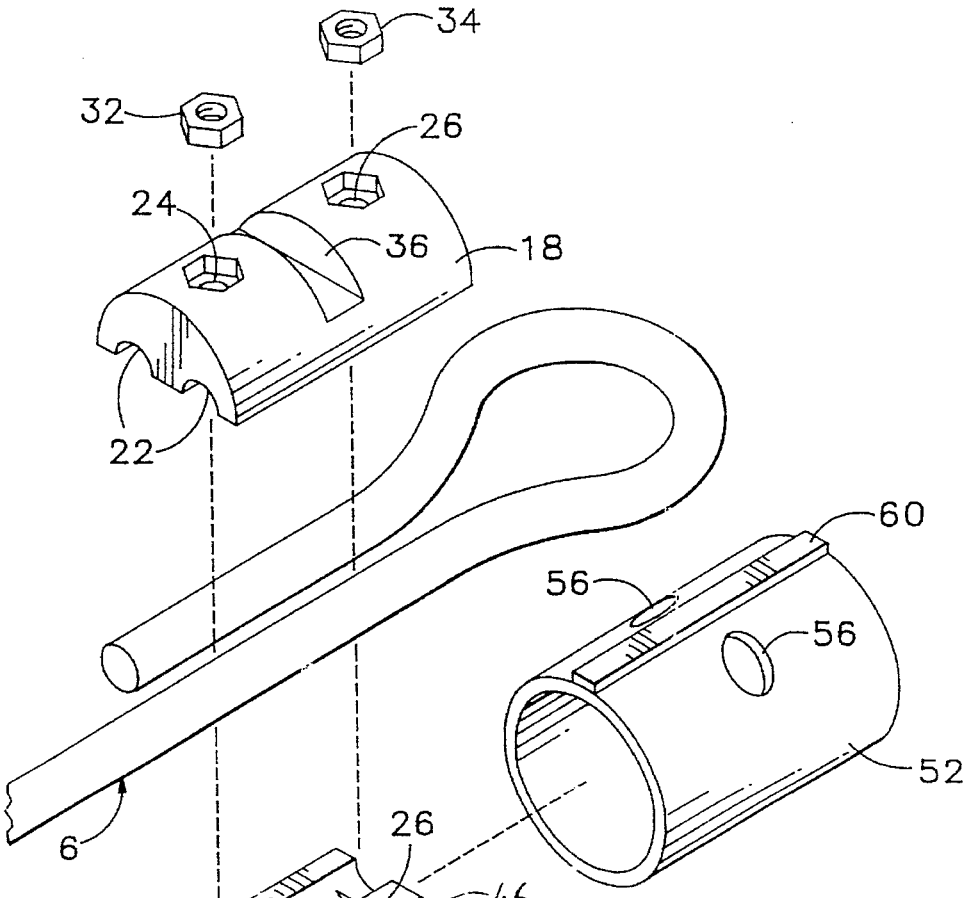
FIG. 2 is a partially exploded perspective view of the termination device.
Figure 1:
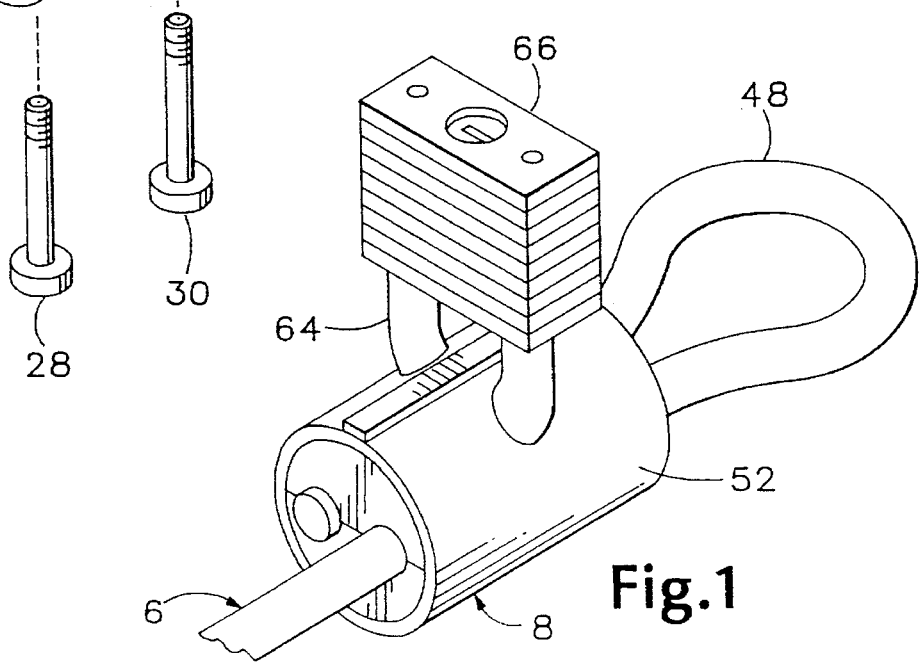
FIG. 1 is a perspective view from above of a cable that is equipped with a termination device forming a loop.

FIG. 1 illustrates a length 6 of flexible cable that comprises a steel core and a jacket of elastomeric synthetic polymer material. FIG. 1 also illustrates a termination device 8 that grips two length segments of the cable.

The termination device 8 comprises two jaws 16 and 18 each formed with two parallel longitudinal channels 22. The jaws are typically made by injection molding a synthetic polymer material, such as glass-filled ABS. Each of the two jaws 16 and 18 is formed with two holes 24 and 26. The jaws can be placed in a confronting relationship in which the holes 24, in the two jaws respectively, are in alignment and similarly the holes 26 are in alignment. When the two jaws are thus positioned, security screws 28 and 30, having a drive recess of a configuration that is not compatible with commonly available drive tools, can be inserted through the holes 24 and the holes 26 respectively. The security screws may be of the type sold by Amtork Fastening Industries of Hempstead, N.Y., under the designation PIN-IN-HEAD.

The security screws 28 and 30 are flathead screws, and the holes in the jaw 16 are countersunk to receive the heads of the screws. The screws 28 and 30 are in threaded engagement with respective nuts 32 and 34, which are fitted in recesses in the jaw 18, the recesses being sized and shaped to prevent rotation of the nuts. The jaw 18 is formed with a transverse groove 36 between the recesses that receive the heads 32 and 34.

Figure 3:
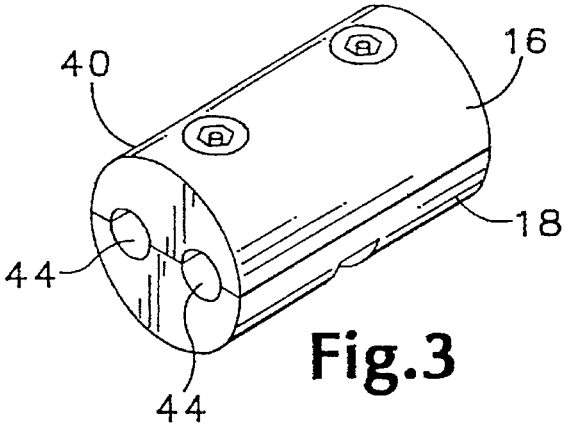
FIG. 3 is a perspective view of the body of the cable termination device, seen from below.

When the two jaws are placed in confronting relationship and are held together by the screws 28 and 30 engaging the nuts 32 and 34 respectively, the two jaws form a generally cylindrical body 40 (FIG. 3) with two passages 44 extending therethrough, parallel to the axis of the cylindrical body. The two jaws cannot be non-destructively separated except by use of a security drive tool that is sized and shaped to fit in the drive recesses of the screws.

The depth of the channels 22 is slightly less than the external radius of the cable 6, so that when two length segments of the cable are placed in the passages 44 respectively, and the screws 28 and 30 are tightened, the jacket of the cable is elastically deformed and the cable is gripped firmly between the two jaws. Increased security in gripping the cable is provided by triangular section ribs 46 extending transversely of each of the longitudinal channels 22. The projections are sufficiently high to deform the jacket but are not so high as to engage the core of the cable and prevent the jaws from being brought into contact. Typically, the core of the cable is about 3/32 inch in diameter, the jacket is about 1/32 inch thick, and the height of the ribs is about 0.015 inch.

When two length segments of the cable, separated by a bight, are gripped between the jaws, a loop 48 is provided at the end of the cable. This loop can be readily opened, provided that the proper drive tool is available, but cannot otherwise be opened.

The termination device also comprises a steel sleeve 52 that fits over the body 40 in sliding fashion. The sleeve 52 is formed with two holes 56 in its wall that are aligned with the transverse groove 36 when the cylindrical body is located fully inside the sleeve. A rib 60 extends lengthwise of the sleeve between the two holes. When the sleeve is fitted over the cylindrical body and the holes 56 are aligned with the transverse groove 36, the shackle 64 of a padlock 66 can be fitted through the holes 56, and the shackle then lies in the transverse groove 36 and prevents the sleeve from being displaced relative to the body 40 to expose the screws. The rib 60 strengthens the sleeve 52 and prevents removal of the padlock except through use of the proper key to release the shackle.

It will therefore be seen that the illustrated termination device provides the ability to form a loop at the end of a cable without use of special crimping tools, and that allows the loop to be selectively opened and closed by a person having the appropriate key and drive tool. By use of the security screws and the padlock, two levels of security against opening of the loop are provided.

Figure 4:
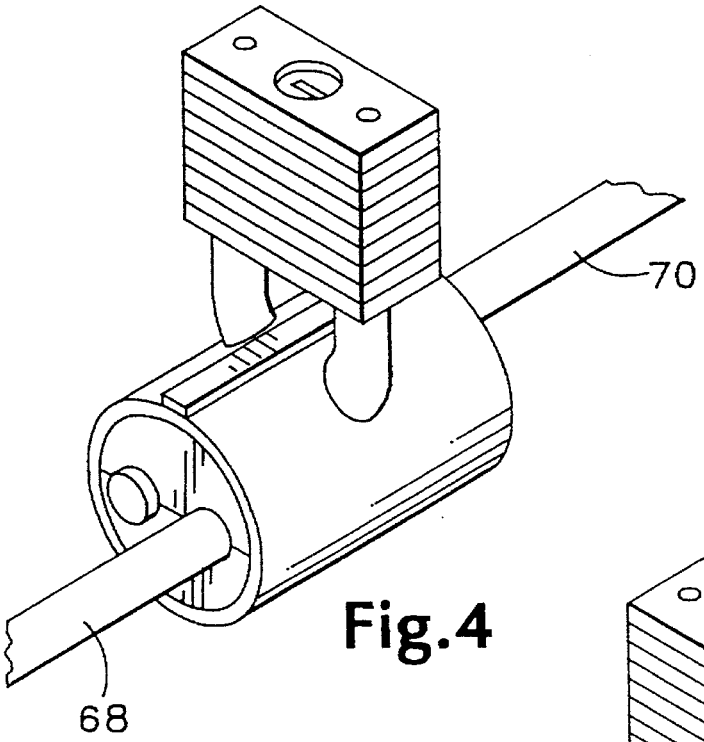
FIG. 4 is a view similar to FIG. 1 illustrating use of the termination device for attaching two cables in end-to-end relationship.

As shown in FIG. 4, the termination device can be used to secure two cables 68,70 together end-to-end.

Figure 5:
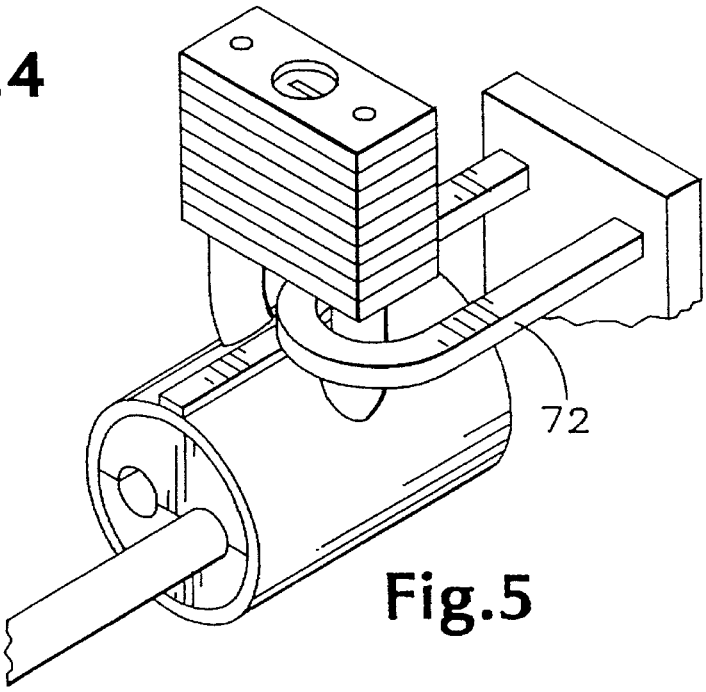
FIG. 5 is a view similar to FIG. 1 illustrating use of the termination device to attach a cable to a staple that is secured to a mechanical ground.

FIG. 5 shows use of the termination device to attach an end of a cable to a staple 72 that is secured to a mechanical ground. In another application, a second cable could be fitted through the holes 56 in the sleeve and the transverse groove 36, provided the ends of the second cable were secured.

It will be appreciated that the invention is not restricted to the particular embodiment that has been described, and that variations may be made therein without departing from the scope of the invention as defined in the appended claims.

I claim:

1. A device for attachment to a length of rod-like material, comprising:

first and second discrete jaw members each having a clamping face in which it is formed with at least one recess and also having a peripheral surface and being formed with a bore extending therethrough from the peripheral surface to the clamping face, whereby when the jaw members are placed with their clamping faces in confronting relationship, the recesses form a cavity for receiving the length of rod-like material and the bores in the first and second jaw members are mutually aligned, and at least one removable clamping element for clamping the jaw members together with their clamping faces in confronting relationship and thereby releasably retaining the length of rod-like material in the cavity, the clamping element comprising a screw and a nut, the screw extending through the axially aligned bores in the first and second jaw members and having a head that engages the peripheral surface of the first jaw member, and the nut being in threaded engagement with the screw and engaging the peripheral surface of the second jaw member.

2. A device according to claim 1, wherein the screw is a flathead screw, the bore in the first jaw member being countersunk to receive the head of the screw and the second jaw member being formed with a recess surrounding the bore for receiving the nut and retaining the nut against rotation.

3. A device according to claim 1, further comprising:

a sleeve for fitting over the jaw members and preventing removal of the clamping element, and a retaining element for holding the sleeve in position relative to the jaw members.

4. A device according to claim 3, wherein one of the jaw members is formed with a groove and the sleeve is formed with apertures that align with the groove when the sleeve is fitted over the jaw members, and the retaining element comprises a padlock having a shackle that extends through the holes in the sleeve and passes within the groove with an interference fit relative to said one of the first and second jaw members.

5. A device according to claim 4, wherein the jaw members are each formed with two bores extending therethrough and the device comprises two clamping elements received in the two bores respectively, and wherein the groove is disposed between the two clamping elements.

6. A device for securing two lengths of rod-like material together, comprising:

first and second discrete jaw members each having a clamping face in which it is formed with two recesses and also having a peripheral surface and being formed with a bore extending therethrough from the peripheral surface to the clamping face, whereby when the jaw members are placed with their clamping faces in confronting relationship, the recesses form two cavities for receiving the two lengths of rod-like material respectively and the bores in the first and second jaw members are mutually aligned and extend between the two cavities, and at least one removable clamping element for releasably clamping the jaw members together with their clamping faces in confronting relationship and thereby releasably retaining the two lengths of rod-like material in the cavities respectively, the clamping element comprising a screw and a nut, the screw extending through the axially aligned bores in the first and second jaw members and having a head that engages the peripheral surface of the first jaw member, and the nut being in threaded engagement with the screw and engaging the peripheral surface of the second jaw member.

7. A device according to claim 6, wherein the screw is a flathead screw, the bore in the first jaw member being countersunk to receive the head of the screw and the second jaw member being formed with a recess surrounding the bore for receiving the nut and retaining the nut against rotation.

8. A device according to claim 6, further comprising:

a sleeve for fitting over the jaw members and preventing removal of the clamping element, and a retaining element for holding the sleeve in position relative to the jaw members.

9. A device according to claim 8, wherein one of the jaw members is formed with a groove and the sleeve is formed with apertures that align with the groove when the sleeve is fitted over the jaw members, and the retaining element comprises a padlock having a shackle that extends through the holes in the sleeve and passes within the groove with an interference fit relative to said one of the first and second jaw members.

10. A device according to claim 9, wherein the jaw members are each formed with two bores extending therethrough and the device comprises two clamping elements received in the two bores respectively, and wherein the groove is disposed between the two clamping elements.

11. A device according to claim 1, for attachment to a length of cable having a metal core of a first radius and an elastomeric jacket of a second radius, wherein the recesses are of generally semi-cylindrical form of radius substantially equal to said second radius, whereby the cavity formed when the clamping faces are in confronting relationship is generally cylindrical, and at least one jaw member is formed with projections extending into the recess and of a height such that when the cable is in the cavity and the clamping faces of the jaw elements are in contact with one another, the projections deform the elastomeric jacket of the cable without engaging the core of the cable.

12. A device according to claim 1, wherein the peripheral surfaces of the jaw members are substantially semi-cylindrical, whereby the first and second jaw members, when clamped together, form a generally cylindrical body, and the device further comprises a cylindrical sleeve that fits slidably over the generally cylindrical body.

13. A device according to claim 1, wherein the clamping element is a security screw.

14. A device according to claim 6, for securing two lengths of a cable having a metal core of a first radius and an elastomeric jacket of a second radius, wherein the recesses are of generally semi-cylindrical form of radius substantially equal to said second radius, whereby the cavities formed when the clamping faces are in confronting relationship are generally cylindrical, and at least one jaw member is formed with projections extending into the recesses and of a height such that when the two lengths of the cable are in the cavities respectively and the clamping faces of the jaw elements are in contact with one another, the projections deform the elastomeric jacket of the cable without engaging the core of the cable.

15. A device according to claim 6, wherein the peripheral surfaces of the jaw members are substantially semi-cylindrical, whereby the first and second jaw members, when clamped together, form a generally cylindrical body, and the device further comprises a cylindrical sleeve that fits slidably over the generally cylindrical body.

16. A device according to claim 6, wherein the clamping element is a security screw.

17. A device for attachment to a length of rod-like material, comprising:

first and second jaw members each having a clamping face in which it is formed with at least one recess, whereby when the jaw members are placed with their clamping faces in confronting relationship, the recesses form a cavity for receiving the length of rod-like material, at least one of the jaw members being formed with a groove, at least one removable clamping element for clamping the jaw members together and thereby releasably retaining the length of rod-like material in the cavity, a sleeve for fitting over the jaw members and preventing removal of the clamping element, the sleeve being formed with apertures that align with the groove when the sleeve is fitted over the jaw members, and a padlock having a shackle that extends through the holes in the sleeve and passes within the groove with an interference fit relative to said one of the first and second jaw members for holding the sleeve in position relative to the jaw members.

18. A device according to claim 17, wherein the jaw members are each formed with two bores extending therethrough and the device comprises two clamping elements received in the two bores respectively, and wherein the groove is disposed between the two clamping elements.

19. A device according to claim 17, wherein the first and second jaw members are formed with bores extending therethrough and the clamping element comprises a flathead screw, having a head, and a nut in threaded engagement with the screw, the bore in the first jaw member being countersunk to receive the head of the screw and the second jaw member being formed with a recess surrounding the bore for receiving the nut and retaining the nut against rotation.

20. A device for securing two lengths of rod-like material together, comprising:

first and second jaw members each having a clamping face in which it is formed with two recesses, whereby when the jaw members are placed with their clamping faces in confronting relationship, the recesses form two cavities for receiving the two lengths of rod-like material respectively, at least one of the jaw members being formed with a groove, at least one removable clamping element for clamping the jaw members together and thereby releasably retaining the two lengths of rod-like material in the cavities respectively, a sleeve for fitting over the jaw members and preventing removal of the clamping element, the sleeve being formed with apertures that align with the groove when the sleeve is fitted over the jaw members, and a padlock having a shackle that extends through the holes in the sleeve and passes within the groove with an interference fit relative to said one of the first and second jaw members for holding the sleeve in position relative to the jaw members.

21. A device according to claim 20, wherein the jaw members are each formed with two bores extending therethrough and the device comprises two clamping elements received in the two bores respectively, and wherein the groove is disposed between the two clamping elements.

22. A device according to claim 20, wherein the first and second jaw members are formed with bores extending therethrough and the clamping element comprises a flathead screw, having a head, and a nut in threaded engagement with the screw, the bore in the first jaw member being countersunk to receive the head of the screw and the second jaw member being formed with a recess surrounding the bore for receiving the nut and retaining the nut against rotation.

* * * * *